US009180579B2

(12) United States Patent
Hsu

(10) Patent No.: US 9,180,579 B2
(45) Date of Patent: Nov. 10, 2015

(54) COMBINATION SCREWDRIVER

(71) Applicant: Huang-Tung Hsu, Taichung (TW)

(72) Inventor: Huang-Tung Hsu, Taichung (TW)

( * ) Notice: Subject to any disclaimer, the term of this patent is extended or adjusted under 35 U.S.C. 154(b) by 388 days.

(21) Appl. No.: 13/887,472

(22) Filed: May 6, 2013

(65) Prior Publication Data

US 2014/0326111 A1 Nov. 6, 2014

(51) Int. Cl.

*B25B 15/00* (2006.01)
*B25G 1/08* (2006.01)
*B25B 15/02* (2006.01)

(52) U.S. Cl.

CPC ..... *B25B 15/00* (2013.01); *B25B 15/02* (2013.01); *B25G 1/08* (2013.01); *B25G 1/085* (2013.01)

(58) Field of Classification Search

CPC ..... B25G 1/085; B25G 1/066; B25G 1/08; B25B 15/008; B25B 13/56; B25B 15/00; B25B 15/02

See application file for complete search history.

(56) References Cited

U.S. PATENT DOCUMENTS

| | | | | |
|---|---|---|---|---|
| 5,675,866 | A * | 10/1997 | Tseng | 16/111.1 |
| 5,749,271 | A * | 5/1998 | Liu | 81/60 |
| 7,051,626 | B1 * | 5/2006 | Chen et al. | 81/438 |
| 7,395,739 | B1 * | 7/2008 | Chen | 81/177.4 |
| 8,833,214 | B2 * | 9/2014 | Wang | 81/490 |
| 2010/0294091 | A1 * | 11/2010 | Chen | 81/438 |
| 2012/0304835 | A1 * | 12/2012 | Hsu | 81/177.4 |

* cited by examiner

*Primary Examiner* — Robert Scruggs
(74) *Attorney, Agent, or Firm* — Alan D. Kamrath; Kamrath IP Lawfirm, P.A.

(57) ABSTRACT

A combination screwdriver includes a handle having a receiving chamber, a fixed plate secured in the receiving chamber of the handle, a push button movably mounted in the receiving chamber of the handle, a compression spring mounted in the receiving chamber of the handle and biased between the fixed plate and the push button, a tool holder movably mounted in the receiving chamber of the handle and holding a plurality of tips, and a restoring spring mounted in the receiving chamber of the handle and biased between the fixed plate and the tool holder. Thus, the tool holder is sprung outward and partially protruded from the handle by pressing the push button to expose the tips for selection of the user so that the user can take and operate the tips easily and quickly.

8 Claims, 9 Drawing Sheets

COMBINATION SCREWDRIVER

BACKGROUND OF THE INVENTION

1. Field of the Invention

The present invention relates to a hand tool and, more particularly, to a combination screwdriver.

2. Description of the Related Art

A conventional combination screwdriver comprises a handle having a first end provided with a receiving chamber and a second end provided with a socket, a plurality of tips mounted in the receiving chamber of the handle, and a cover removably mounted on the handle to cover the receiving chamber of the handle and to limit the tips in the receiving chamber of the handle. When in use, the cover is removed from the handle to expose the tips. Then, one of the tips is taken out of the receiving chamber of the handle and is inserted into the socket for operation of a user. Thus, the tips are stored in the receiving chamber of the handle to largely reduce the whole volume of the combination screwdriver. However, the receiving chamber of the handle has a small diameter so that when many tips are contained in the receiving chamber of the handle, the required tip cannot be taken out of the receiving chamber of the handle easily and quickly, thereby causing inconvenience to the user.

BRIEF SUMMARY OF THE INVENTION

In accordance with the present invention, there is provided a combination screwdriver comprising a handle having a receiving chamber, a fixed plate secured in the receiving chamber of the handle, a push button movably mounted in the receiving chamber of the handle, a compression spring mounted in the receiving chamber of the handle and biased between the fixed plate and the push button, a tool holder movably mounted in the receiving chamber of the handle, and a restoring spring mounted in the receiving chamber of the handle and biased between the fixed plate and the tool holder. The handle has a side provided with a socket unit. The fixed plate is provided with a through hole and two slots. The fixed plate is provided with two limit posts each disposed between the through hole and a respective one of the slots. The push button is made of a plastic material. The push button has a first end provided with a pressing portion and a second end provided with two limit hooks and two positioning hooks. Each of the positioning hooks of the push button has a distal end provided with a locking portion. Each of the positioning hooks of the push button is provided with an thrust portion. The thrust portion of each of the positioning hooks has a tapered shape. The tool holder has a shank provided with a plurality of mounting seats for mounting a plurality of tips. The tool holder has a first end provided with a grip portion and a second end provided with an abutting portion. The abutting portion of the tool holder has a side provided with a locking knob releasably clamped between the positioning hooks of the push button. The compression spring is biased between the fixed plate and the pressing portion of the push button. The restoring spring is biased between the fixed plate and the abutting portion of the tool holder.

The primary objective of the present invention is to provide a combination screwdriver that can expose tips automatically.

According to the primary advantage of the present invention, the tool holder is sprung outward and partially protruded from the handle by pressing the push button to expose the tips automatically for selection of the user so that the user can take and operate the tips easily and quickly.

According to another advantage of the present invention, when the tool holder is pressed inward, the tool holder is locked onto the push button, and when the push button is pressed inward, the tool holder is unlocked from the push button, so that the tool holder is locked and unlocked easily and conveniently, thereby greatly facilitating the user operating, storing and carrying the tips.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

FIG. 2A is a perspective enlarged view of a fixed plate of the combination screwdriver as shown in FIG. 2.

DETAILED DESCRIPTION OF THE INVENTION

Figure 1:
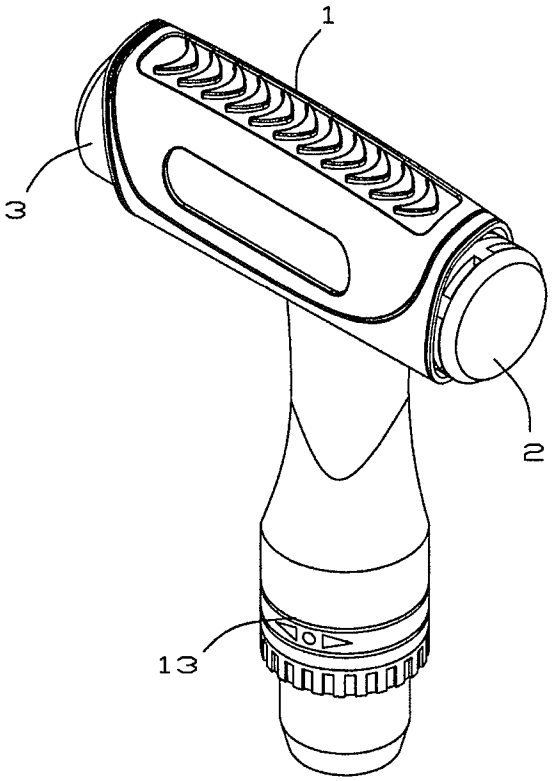
FIG. 1 is a perspective view of a combination screwdriver in accordance with the preferred embodiment of the present invention.

Referring to the drawings and initially to FIGS. 1-6, a combination screwdriver in accordance with the preferred embodiment of the present invention comprises a handle 1 having a receiving chamber 11, a fixed plate 12 secured in the receiving chamber 11 of the handle 1, a push button 2 movably mounted in the receiving chamber 11 of the handle 1, a compression spring 24 mounted in the receiving chamber 11 of the handle 1 and biased between the fixed plate 12 and the push button 2, a tool holder 3 movably mounted in the receiving chamber 11 of the handle 1, and a restoring spring 37 mounted in the receiving chamber 11 of the handle 1 and biased between the fixed plate 12 and the tool holder 3.

The handle 1 has a side provided with a socket unit 13. The socket unit 13 is perpendicular to the receiving chamber 11 of the handle 1. A user can hold handle 1 to drive and rotate the socket unit 13. Preferably, the socket unit 13 is a ratchet socket.

The fixed plate 12 is located between the compression spring 24 and the restoring spring 37. The fixed plate 12 has a periphery provided with a retaining flange 125. The fixed plate 12 is provided with a through hole 121 and two slots 122. The through hole 121 of the fixed plate 12 is disposed between the slots 122. The fixed plate 12 is provided with two limit posts 123 (see FIG. 2A) each disposed between the through hole 121 and a respective one of the slots 122. Each of the limit posts 123 of the fixed plate 12 has a side provided with a guide portion 124 connected to the respective slot 122. Each of the limit posts 123 of the fixed plate 12 has a first end located adjacent to the push button 2 and a second end located adjacent to the tool holder 3. The guide portion 124 of each of the limit posts 123 has a tapered shape and has a thickness increased gradually from the first end toward the second end of each of the limit posts 123.

The push button 2 is made of a plastic material. The push button 2 has a first end provided with a pressing portion 21 and a second end provided with two limit hooks 22 and two positioning hooks 23. The pressing portion 21 of the push button 2 protrudes outward from the receiving chamber 11 of the handle 1. The limit hooks 22 of the push button 2 are disposed between the positioning hooks 23.

Each of the limit hooks 22 of the push button 2 is extended through the through hole 121 of the fixed plate 12 and is detachably hooked on a respective one of the limit posts 123 to prevent the push button 2 from being detached from the fixed plate 12.

Each of the positioning hooks 23 of the push button 2 is flexible and has a distal end provided with a locking portion 231. Each of the positioning hooks 23 of the push button 2 has a mediate section provided with an thrust portion 232. The thrust portion 232 of each of the positioning hooks 23 has a tapered shape and is located between the locking portion 231 and the pressing portion 21. Each of the positioning hooks 23 of the push button 2 is extended through a respective one of the slots 122. Each of the positioning hooks 23 of the push button 2 passes a respective one of the limit posts 123 of the fixed plate 12 and abuts the guide portion 124 of the respective limit post 123. The thrust portion 232 of each of the positioning hooks 23 is movable to abut the guide portion 124 of the respective limit post 123 so that the positioning hooks 23 of the push button 2 are pressed outward relative to each other.

The compression spring 24 is biased between the fixed plate 12 and the pressing portion 21 of the push button 2 to push the pressing portion 21 of the push button 2 to protrude outward from the receiving chamber 11 of the handle 1.

The tool holder 3 has a shank 32 provided with a plurality of mounting seats 33 for mounting a plurality of tips 34 which can be inserted into the socket unit 13 of the handle 1. The tool holder 3 has a first end provided with a grip portion 31 and a second end provided with an abutting portion 35. The shank 32 of the tool holder 3 is located between the grip portion 31 and the abutting portion 35. The mounting seats 33 of the tool holder 3 are located between the grip portion 31 and the abutting portion 35. The grip portion 31 of the tool holder 3 protrudes outward from the receiving chamber 11 of the handle 1. The abutting portion 35 of the tool holder 3 has a side provided with a locking knob 36 releasably clamped between the positioning hooks 23 of the push button 2. The locking knob 36 of the tool holder 3 has an arcuate face facing the positioning hooks 23 of the push button 2. The abutting portion 35 of the tool holder 3 is located between the shank 32 and the locking knob 36.

The restoring spring 37 is biased between the fixed plate 12 and the abutting portion 35 of the tool holder 3 to push the grip portion 31 of the tool holder 3 to detach from the receiving chamber 11 of the handle 1. The restoring spring 37 has a first end secured on the retaining flange 125 of the fixed plate 12 and a second end pressing the abutting portion 35 of the tool holder 3.

Figure 2:
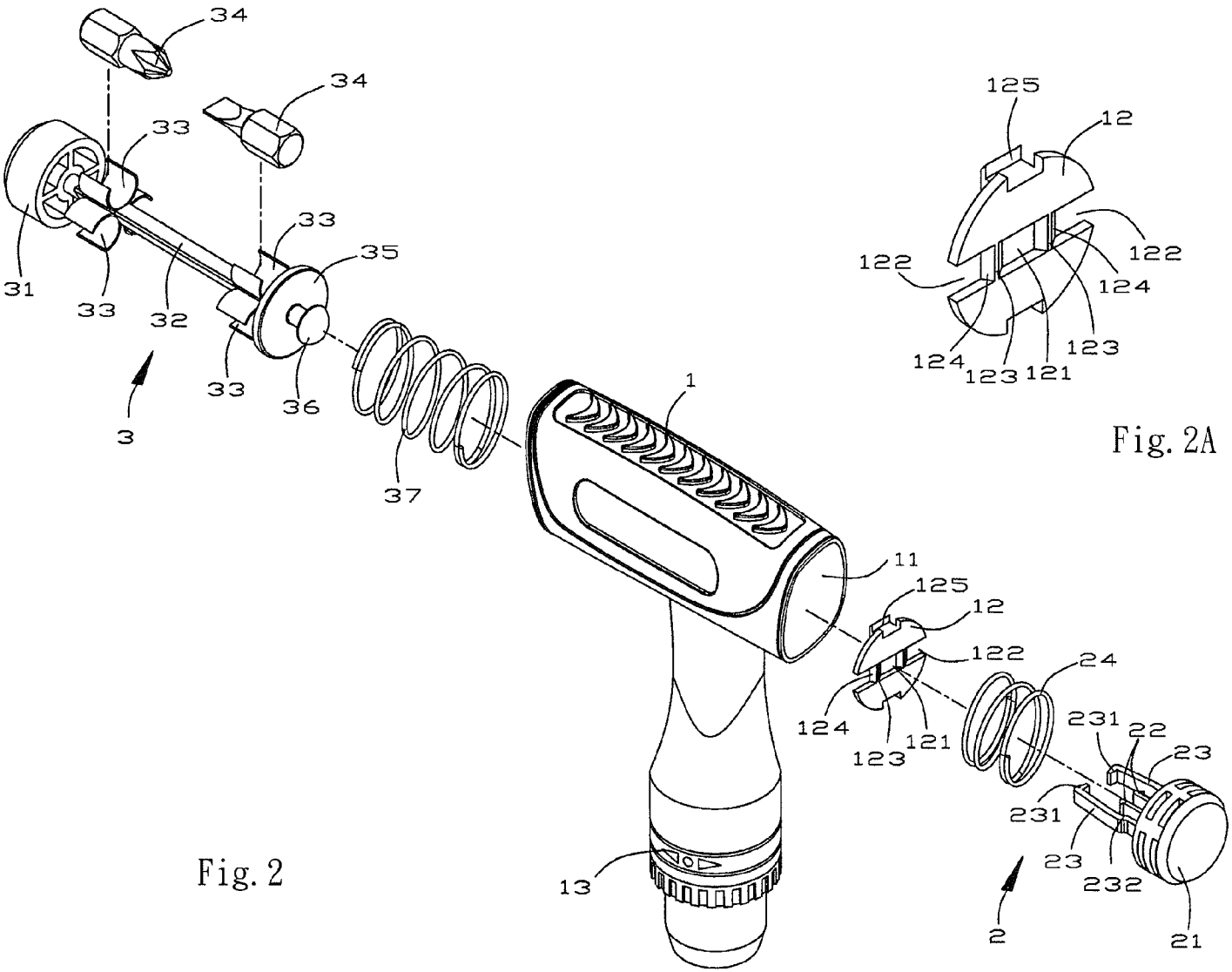
FIG. 2 is an exploded perspective view of the combination screwdriver as shown in FIG. 1.
Figure 3:
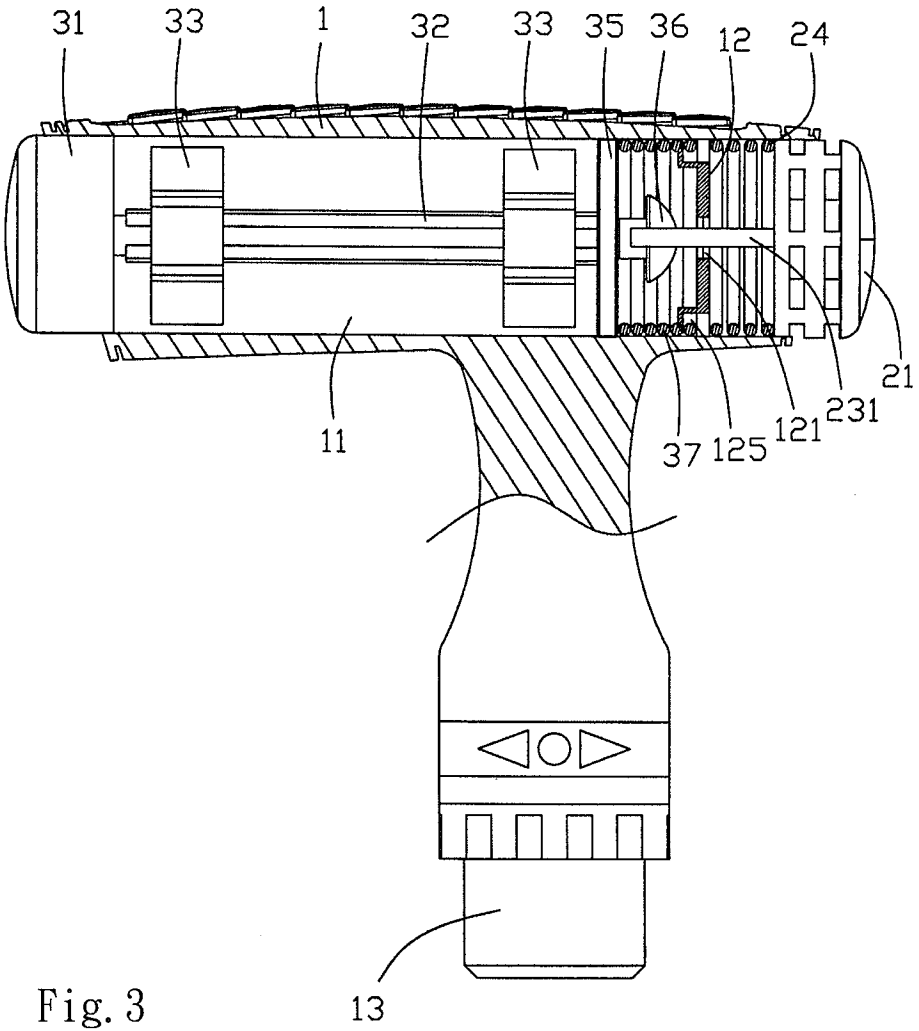
FIG. 3 is a partially front cross-sectional view of the combination screwdriver as shown in FIG. 1.
Figure 4:
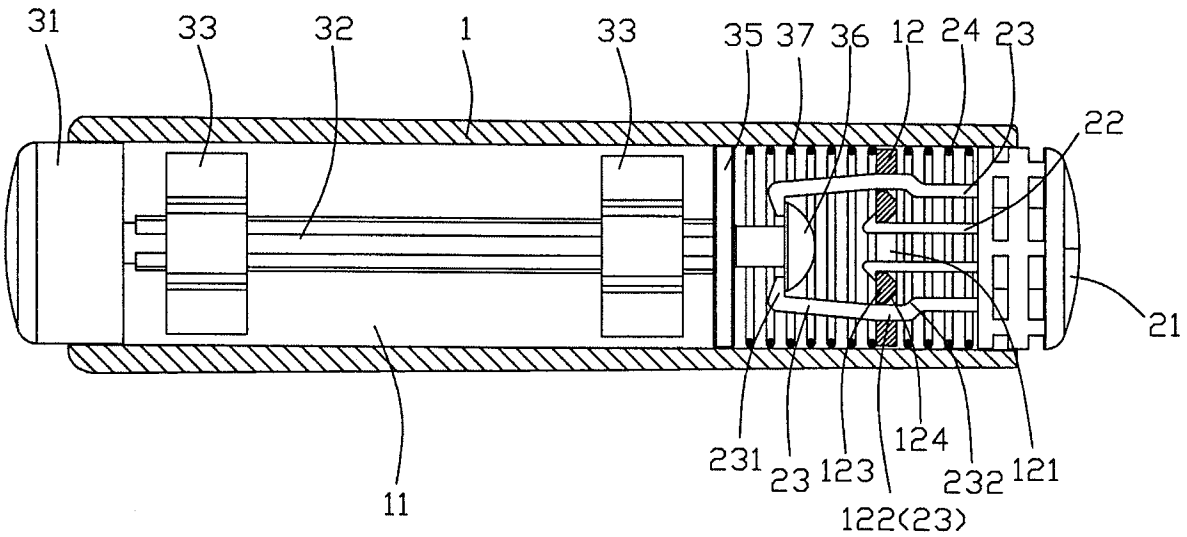
FIG. 4 is a top cross-sectional view of the combination screwdriver as shown in FIG. 1.

In assembly, referring to FIGS. 1-4, the fixed plate 12 is initially secured in the receiving chamber 11 of the handle 1. Then, the push button 2 and the compression spring 24 are placed into the receiving chamber 11 of the handle 1. Then, the positioning hooks 23 of the push button 2 are moved to extend through the slots 122 of the fixed plate 12, and the limit hooks 22 of the push button 2 is moved to extend through the through hole 121 of the fixed plate 12. In such a manner, the compression spring 24 is biased between the fixed plate 12 and the pressing portion 21 of the push button 2 and pushes the pressing portion 21 of the push button 2 outward from the receiving chamber 11 of the handle 1, so that the limit hooks 22 of the push button 2 are moved and hooked on the limit posts 123 of the fixed plate 12 to lock the push button 2 onto the fixed plate 12 so as to prevent the push button 2 from being detached from the receiving chamber 11 of the handle 1. Then, the restoring spring 37 is placed into the receiving chamber 11 of the handle 1. At this time, the first end of the restoring spring 37 is hooked onto the retaining flange 125 of the fixed plate 12 so that the restoring spring 37 is affixed to the fixed plate 12 and will not be detached from the receiving chamber 11 of the handle 1. Then, the tool holder 3 together with the tips 34 is placed into the receiving chamber 11 of the handle 1 and is pushed toward the fixed plate 12. At this time, the abutting portion 35 of the tool holder 3 is moved to abut the restoring spring 37, and the locking knob 36 of the tool holder 3 is moved to abut the locking portion 231 of each of the positioning hooks 23. Then, the grip portion 31 of the tool holder 3 is pressed toward the fixed plate 12 so that the abutting portion 35 of the tool holder 3 is moved to compress the restoring spring 37, and the locking knob 36 of the tool holder 3 is moved to outward expand the positioning hooks 23 of the push button 2. After the locking knob 36 of the tool holder 3 passes through the locking portion 231 of each of the positioning hooks 23, the positioning hooks 23 of the push button 2 are contracted inward by their resilience so that the locking knob 36 of the tool holder 3 is locked by the locking portion 231 of each of the positioning hooks 23. In such a manner, the locking knob 36 of the tool holder 3 is inserted between and locked by the positioning hooks 23 of the push button 2 as shown in FIG. 4 so that the tool holder 3 is locked onto the push button 2.

Figure 5:
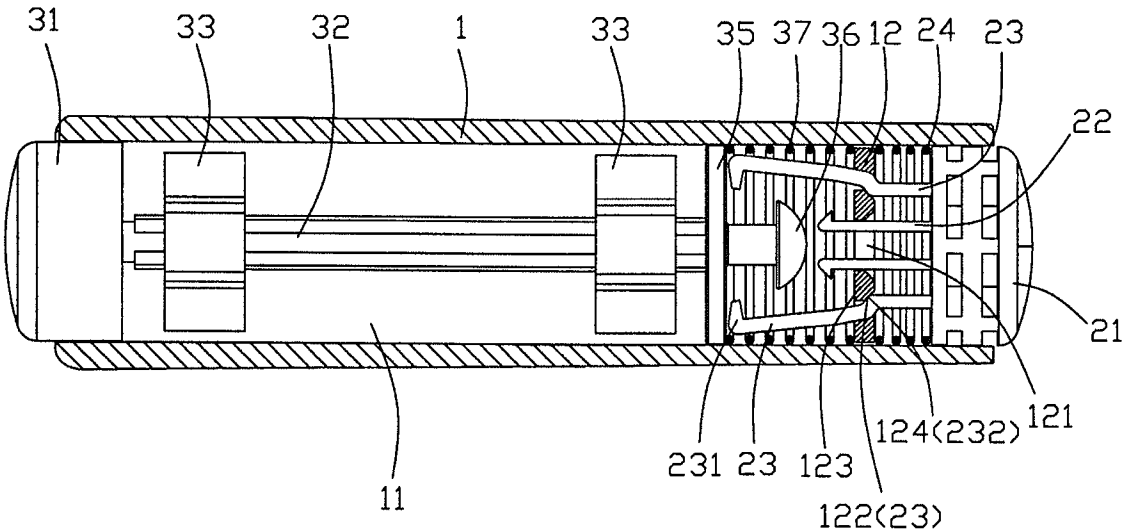
FIG. 5 is a schematic operational view of the combination screwdriver as shown in FIG. 4.
Figure 6:
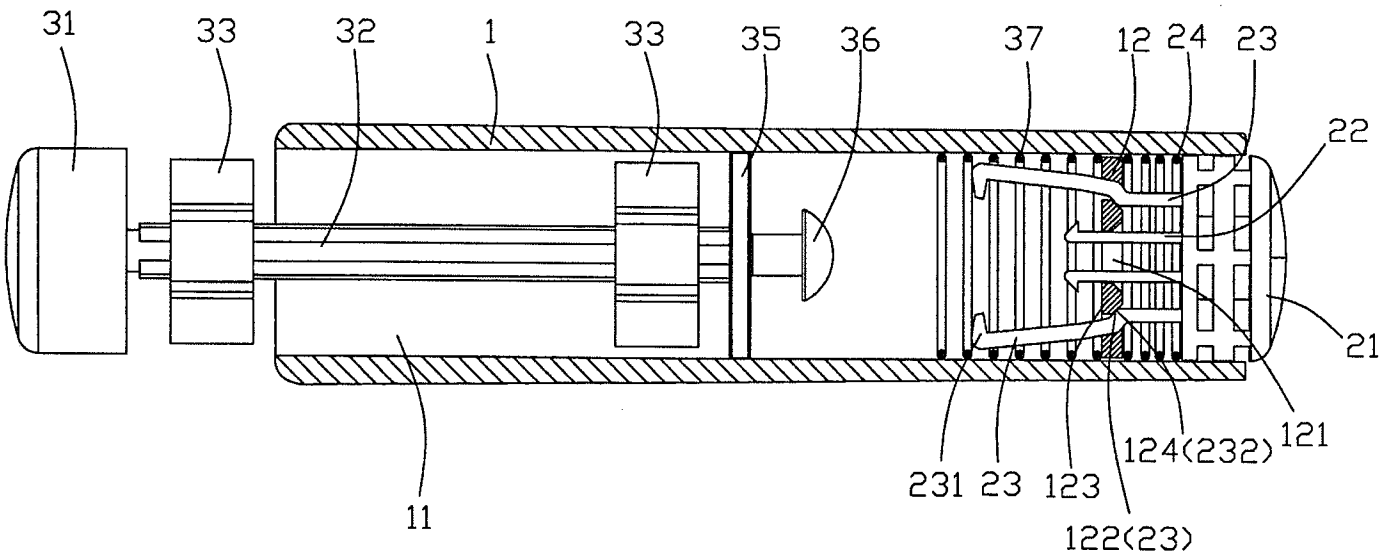
FIG. 6 is a schematic operational view of the combination screwdriver as shown in FIG. 5.

In operation, referring to FIGS. 4-6 with reference to FIGS. 1-3, the pressing portion 21 of the push button 2 is pushed toward the fixed plate 12 to move the positioning hooks 23 toward the tool holder 3 so that the thrust portion 232 of each of the positioning hooks 23 is moved to abut the respective limit post 123 of the fixed plate 12. At this time, the thrust portion 232 of each of the positioning hooks 23 is pushed outward and guided by the guide portion 124 of the respective limit post 123 so that the positioning hooks 23 of the push button 2 are pressed and expanded outward relative to each other as shown in FIG. 5. In such a manner, the locking knob 36 of the tool holder 3 is released from the positioning hooks 23 of the push button 2 to unlock the tool holder 3 from the push button 2 so that the abutting portion 35 of the tool holder 3 is pushed outward by the restoring force of the restoring spring 37 to detach the mounting seats 33 of the tool holder 3 from the receiving chamber 11 of the handle 1 as shown in FIG. 6. Thus, the mounting seats 33 of the tool holder 3 are released from the receiving chamber 11 of the handle 1 to expose the tips 34 outward for selection of the user.

Accordingly, the tool holder 3 is sprung outward and partially protruded from the handle 1 by pressing the push button 2 to expose the tips 34 automatically for selection of the user so that the user can take and operate the tips 34 easily and quickly. In addition, when the tool holder 3 is pressed inward, the tool holder 3 is locked onto the push button 2, and when the push button 2 is pressed inward, the tool holder 3 is unlocked from the push button 2, so that the tool holder 3 is locked and unlocked easily and conveniently, thereby greatly facilitating the user operating, storing and carrying the tips 34.

Figure 7:
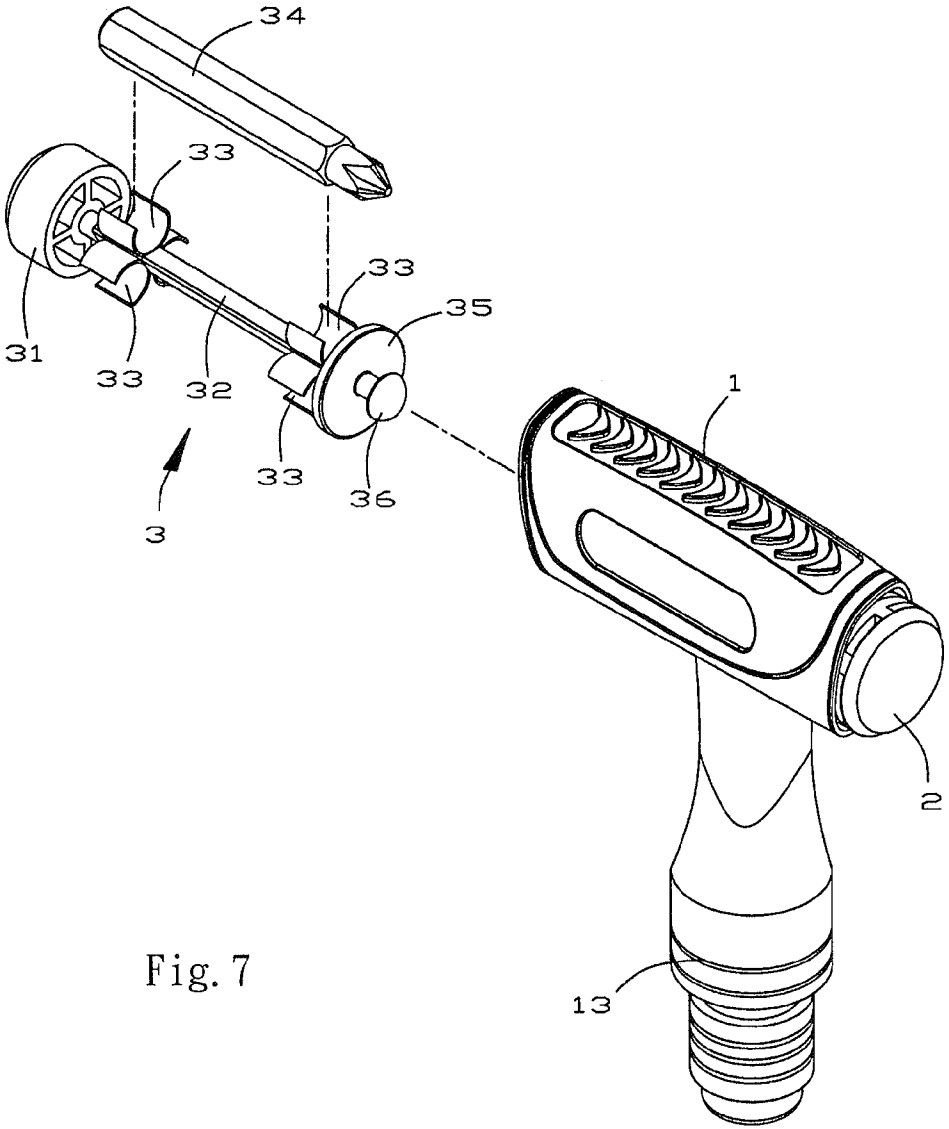
FIG. 7 is a partially exploded perspective view of a combination screwdriver in accordance with another preferred embodiment of the present invention.
Figure 8:
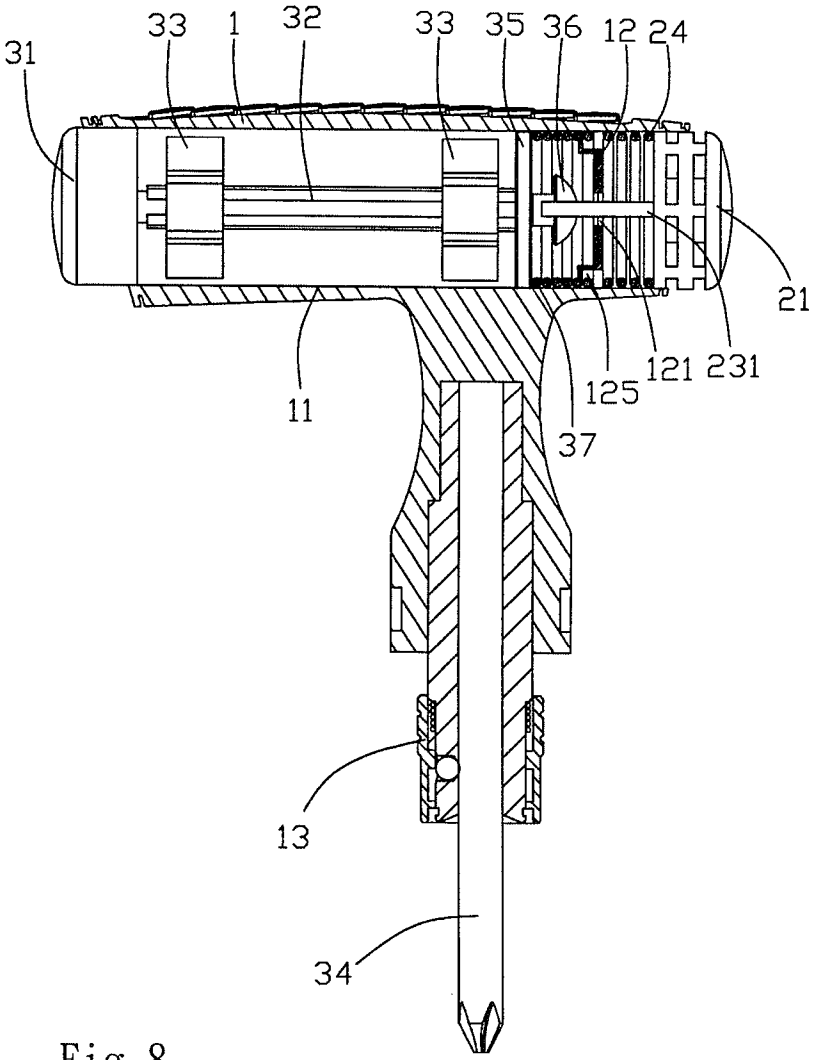
FIG. 8 is a front cross-sectional assembly view of the combination screwdriver as shown in FIG. 7.
Figure 9:
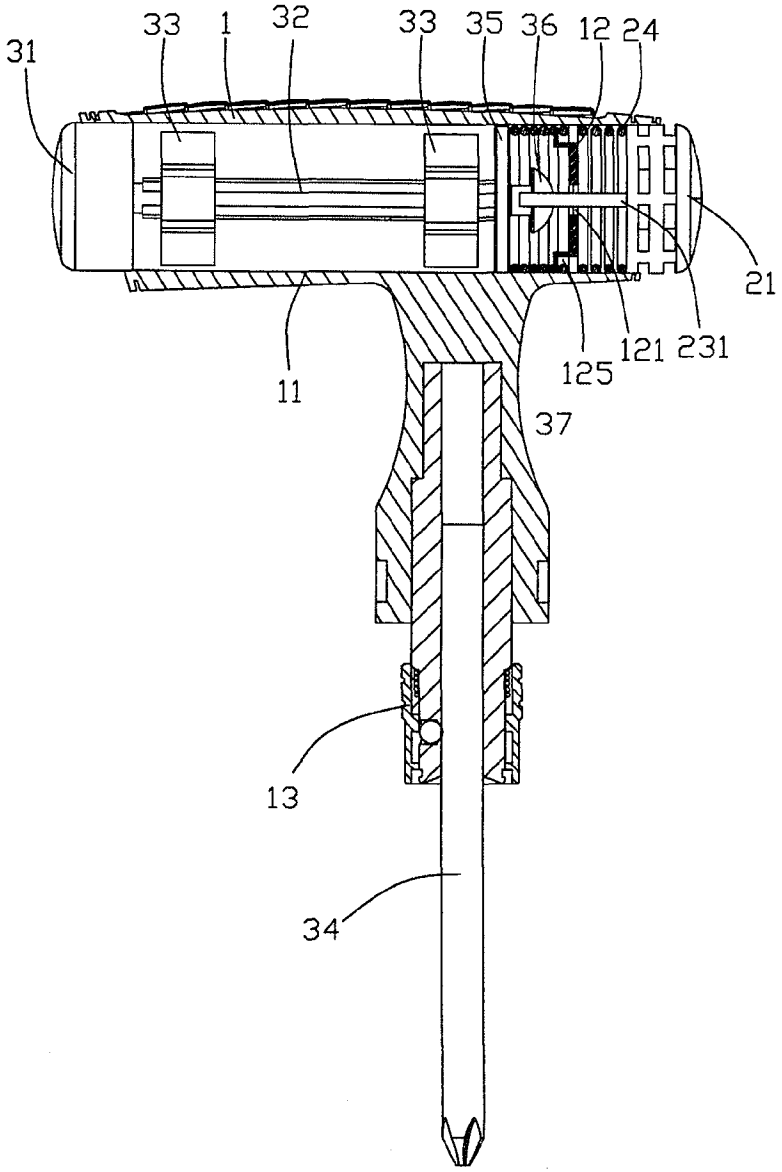
FIG. 9 is a front cross-sectional view of a combination screwdriver in accordance with another preferred embodiment of the present invention.

Referring to FIGS. 7-9, the socket unit 13 is a quick release socket. In addition, the tips 34 have different length to satisfy the user's requirements.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A combination screwdriver, comprising:

a handle having a receiving chamber;

a fixed plate secured in the receiving chamber of the handle;

a push button movably mounted in the receiving chamber of the handle;

a compression spring mounted in the receiving chamber of the handle and biased between the fixed plate and the push button;

a tool holder movably mounted in the receiving chamber of the handle; and a restoring spring mounted in the receiving chamber of the handle and biased between the fixed plate and the tool holder; wherein:

the handle has a side provided with a socket unit;

the fixed plate is provided with a through hole and two slots;

the fixed plate is provided with two limit posts each disposed between the through hole and a respective one of the slots;

the push button is made of a plastic material;

the push button has a first end provided with a pressing portion and a second end provided with two limit hooks and two positioning hooks;

each of the positioning hooks of the push button has a distal end provided with a locking portion;

each of the positioning hooks of the push button is provided with an thrust portion;

the thrust portion of each of the positioning hooks has a tapered shape;

the tool holder has a shank provided with a plurality of mounting seats for mounting a plurality of tips;

the tool holder has a first end provided with a grip portion and a second end provided with an abutting portion;

the abutting portion of the tool holder has a side provided with a locking knob releasably clamped between the positioning hooks of the push button;

the compression spring is biased between the fixed plate and the pressing portion of the push button; and the restoring spring is biased between the fixed plate and the abutting portion of the tool holder.

2. The combination screwdriver of claim 1, wherein:

each of the limit posts of the fixed plate has a side provided with a guide portion connected to the respective slot; and each of the positioning hooks of the push button passes a respective one of the limit posts of the fixed plate and abuts the guide portion of the respective limit post.

3. The combination screwdriver of claim 2, wherein:

each of the limit posts of the fixed plate has a first end located adjacent to the push button and a second end located adjacent to the tool holder; and the guide portion of each of the limit posts has a tapered shape and has a thickness increased gradually from the first end toward the second end of each of the limit posts.

4. The combination screwdriver of claim 3, wherein the thrust portion of each of the positioning hooks is movable to abut the guide portion of the respective limit post so that the positioning hooks of the push button are pressed outward relative to each other.

5. The combination screwdriver of claim 1, wherein:

the fixed plate has a periphery provided with a retaining flange; and the restoring spring has a first end secured on the retaining flange of the fixed plate and a second end pressing the abutting portion of the tool holder.

6. The combination screwdriver of claim 1, wherein each of the limit hooks of the push button is extended through the through hole of the fixed plate and is detachably hooked on a respective one of the limit posts to prevent the push button from being detached from the fixed plate.

7. The combination screwdriver of claim 1, wherein each of the positioning hooks of the push button is extended through a respective one of the slots.

8. The combination screwdriver of claim 1, wherein the locking knob of the tool holder has an arcuate face facing the positioning hooks of the push button.

* * * * *